United States Patent [19]

Lohmann et al.

[11] 4,267,264

[45] May 12, 1981

[54] COLOR PHOTOGRAPHIC RECORDING MATERIAL

[75] Inventors: Joachim W. Lohmann, Kuerten; Otto Lapp; Erwin Ranz, both of Leverkusen, all of Fed. Rep. of Germany

[73] Assignee: AGFA-Gevaert, A.G., Leverkusen, Fed. Rep. of Germany

[21] Appl. No.: 115,923

[22] Filed: Jan. 28, 1980

Related U.S. Application Data

[63] Continuation of Ser. No. 873,740, Jan. 31, 1978, abandoned.

[30] Foreign Application Priority Data

Feb. 5, 1977 [DE] Fed. Rep. of Germany ..... 2704826

[51] Int. Cl.[3] ..... G03C 1/76

[52] U.S. Cl. ..... 430/505; 430/506; 430/507

[58] Field of Search ..... 96/74, 77; 430/505, 430/507, 506

[56] References Cited

U.S. PATENT DOCUMENTS

| | | | |
|---|---|---|---|
| 4,015,988 | 4/1977 | Shiba et al. | 430/505 |
| 4,082,553 | 4/1978 | Groet | 430/505 |

FOREIGN PATENT DOCUMENTS

| | | | |
|---|---|---|---|
| 2018341 | 4/1970 | Fed. Rep. of Germany | 430/505 |
| 2530645 | 1/1975 | Fed. Rep. of Germany | 430/505 |

*Primary Examiner*—Won H. Louie, Jr.

[57] ABSTRACT

A high sensitivity color photographic recording medium has at least two red sensitive component silver halide emulsion layer and at least three green sensitive component silver halide emulsion layers, the sensitivity of layers of the same spectral sensitivity increasing in the direction from the layer support upwards and the more sensitive red-sensitive silver halide emulsion being located between two of the green-sensitive silver halide emulsion layers.

4 Claims, No Drawings

COLOR PHOTOGRAPHIC RECORDING MATERIAL

CROSS REFERENCE

This application is a continuation of application Ser. No. 873,740 filed Jan. 31, 1978 by Joachim W. Lohmann et al, for "Colour Photographic Recording Material" (now abandoned).

This invention relates to a colour photographic recording material comprising several silver halide emulsion layers of which at least two contribute towards producing the cyan component colour image, whilst at least another three contribute towards producing the magenta component colour image with an improved sensitivity-to-graininess ratio and in which an improved sensitivity of the cyan component colour image is obtained by a special layer arrangement.

It is known that coloured photographic images can be produced by using recording materials which, on a substrate, carry a red-sensitive, a green-sensitive and a blue-sensitive silver halide emulsion layer, each of the silver halide emulsion layers containing non-diffusing colour couplers for producing the cyan, the magenta and the yellow component colour image and the colour of the component colour image produced being complementary to the spectral sensitivity of the silver halide emulsion layer. Conventional colour photographic materials also contain further layers such as, for example, a yellow filter layer between the uppermost blue-sensitive silver halide emulsion layer and the underlying green-sensitive silver halide emulsion layer and also an antihalation layer between the support and the lowermost silver halide emulsion layer. Additional intermediate gelatin layers and a cover layer may also be provided.

It is also known that colour photographic images can be produced by using recording materials of the type in which at least two silver halide emulsion layers are respectively provided for producing one or more of the three different component colour images. Thus, according to British Pat. No. 818,687, the lowermost lightsensitive colour forming layer unit of a colour photographic multilayer material consists of two component layers which contain silver halide and colour couplers, are sensitised to light of the same spectral region and of which the upper component layer has the greater sensitivity. German Pat. No. 1,121,470 describes the use of double layers of different sensitivity of which the more sensitive layer produces the lower colour density during colour development. In this way, it is possible to increase sensitivity without at the same time adversely affecting graininess.

Colour photographic recording materials with double or triple layers for the various spectral regions are also known from U.S. Pat. Nos. 3,663,228 and 3,849,138. In their case, too, the upper of the two-component layers sensitive to light of the same spectral region has the higher sensitivity.

However, the layer structures described in the two above-mentioned U.S. patents are essentially intended for increasing the exposure latitude, there being no reference to any increase in sensitivity. FIG. 1*c* of these two U.S. patents shows a material which contains two laminates which are separated from one another by a neutrally grey filter and each of which consists of a red-sensitive, a green-sensitive and a blue-sensitive silver halide emulsion layer. In this case, therefore, the two component layers which are sensitive to light of the same spectral region, but which differ in their sensitivity, are not located adjacent to one another, but instead are located in different laminates of different general sensitivity, several silver halide emulsion layers of different spectral sensitivity, but of comparable general sensitivity, being combined in each laminate. Component layers of the same spectral sensitivity are separated from one another by several layers of different spectral sensitivity and by the grey filter. A similar structure, but with coloured filters, with which a greater exposure latitude is also obtained is known from U.S. Defensive Publication No. T860,004.

In addition, German Offenlegungsschriften Nos. 2,453,654 and 2,453,664 describe layer structures in which, to improve sharpness, red- and/or green-sensitive component layers are arranged over the blue-sensitive silver halide emulsion layer. However, these structures are unfavourable in terms of colour reproduction with the result that materials such as these are only suitable if certain light sources, for example tungsten light, are used.

Finally, it is known from German Offenlegungsschrift No. 2,018,341 that, in order to improve the graininess of a component colour image, it is possible to provide not only two, but even three silver halide emulsion component layers having the same spectral sensitivity, but different general sensitivity, each more sensitive component layer being arranged further away from the support layer than each less sensitive component layer. In addition, in the middle and in the upper component layer, a maximum colour density of at most 0.6 and, together, of at most 1.0 is obtained which may be obtained by reducing the coupler content, i.e. by increasing the ratio of silver halide to coupler.

It is known that the graininess of the magenta component colour image is the most noticeable. This is associated with the fact that the sensitivity of the human eye is at its greatest in the green spectral region. Accordingly, triple layers are used above all for forming the magenta component colour image in highly sensitive materials.

In colour photographic recording materials, the single-layer or double-layer red-sensitive silver halide emulsion layer unit is normally arranged next to the support layer. It is followed by the green-sensitive silver halide emulsion layer unit. Then comes the yellow filter layer which is followed by the blue-sensitive silver halide emulsion layer unit. If, in a material such as this, the green-sensitive silver halide emulsion layer unit consists of three component layers in order to improve the sensitivity-to-graininess ratio, a finer colour grain is obtained in the magenta component colour image, but only at the expense of the red sensitivity because of the relatively high coating of the three component layers of the green-sensitive silver halide emulsion layer unit.

The object of the present invention is to provide a highly sensitive colour photographic recording material for producing multicolour images in which the magenta component colour image shows an improved sensitivity-to-graininess ratio without the sensitivity of the cyan component colour image being adversely affected.

According to the invention, this object is achieved by a special layer arrangement in which the more sensitive red-sensitive silver halide component layer is not arranged below the entire green-sensitive silver halide emulsion layer unit, but instead between two component layers of the green-sensitive silver halide emulsion layer unit and preferably between the least sensitive component layer and the next more sensitive component layer of the green-sensitive silver halide emulsion layer unit.

The present invention relates to a colour photographic recording material containing on a support layer:

(a) at least two red-sensitive silver halide emulsion component layers with incorporated cyan couplers, of which the more sensitive component layer is arranged further away from the support layer and and has a higher ratio of silver halide to coupler than the less sensitive component layer;

(b) at least three green-sensitive silver halide emulsion component layers with incorporated magenta couplers of which each more sensitive component layer is arranged further away from the support layer and has a higher ratio of silver halide to coupler than each less sensitive component layer;

(c) at least one blue-sensitive silver halide emulsion layer with an incorporated yellow coupler;

(d) at least one yellow filter layer and (e) optionally further intermediate layers and/or cover layers in which each of the green-sensitive silver halide emulsion component layers is arranged further away from the support layer than the less sensitive red-sensitive silver halide emulsion layer and in which the more sensitive red-sensitive silver halide emulsion component layer is arranged between two component layers of the green-sensitive silver halide emulsion layer unit and preferably between the least sensitive green-sensitive and the next more sensitive green-sensitive silver halide emulsion component layer.

In one preferred embodiment of the present invention, therefore, the colour photographic recording material comprises, on a preferably transparent support layer, the following layers in the following order (from the bottom upwards):

1. a less sensitive red-sensitive silver halide emulsion layer containing a cyan coupler;
2. a least sensitive green-sensitive silver halide emulsion layer containing a magenta coupler;
3. a more sensitive red-sensitive silver halide emulsion layer containing a cyan coupler, the ratio of silver halide to coupler being higher than in the less-sensitive red-sensitive silver halide emulsion layer (1);
4. a more sensitive green-sensitive silver halide emulsion layer containing a magenta coupler, the ratio of silver halide to coupler being higher than in the least sensitive green-sensitive silver halide emulsion layer (2);
5. a most sensitive green-sensitive silver halide emulsion layer containing a magenta coupler, the ratio of silver halide to coupler being higher than in the more sensitive green-sensitive silver halide emulsion layer (3);
6. a yellow filter layer;
7. a blue-sensitive silver halide emulsion layer containing a yellow coupler.

However, in another less preferred embodiment of the invention, layers 3 and 4 may also be interchanged, in other words the more sensitive red-sensitive silver halide emulsion layer is arranged between the green-sensitive silver halide emulsion layer of medium and maximum sensitivity.

In addition to the layers already mentioned, other non-photosensitive auxiliary layers may be present in the colour photographic material according to the invention, for example adhesion layers, antihalation layers or cover layers, or particularly intermediate layers between the lightsensitive layers, which are intended effectively to prevent developer oxidation products from diffusing from one layer into another layer. To this end, such intermediate layers may also contain certain compounds which are capable of reacting with developer oxidation products. Layers such as these are preferably arranged between adjacent lightsensitive layers of different spectral sensitivity.

In particular, a chloride-containing silver halide emulsion layer of comparatively very low sensitivity and having an average grain diameter of approximately 0.1 μm or less (chloride-Mikrat) may be arranged between the more sensitive red-sensitive silver halide emulsion layer and the green-sensitive silver halide emulsion layer arranged over it, as described in our copending U.S. patent application Ser. No. 797,813, filed May 17, 1977 or in our copending U.K. Patent application No. 20864/77. A layer such as this has a particularly beneficial effect upon the sensitivity of the adjoining red-sensitive and green-sensitive component layers.

According to the invention, each of the above-mentioned light-sensitive layers may be further divided up into two or more component layers provided the above order is not changed. This order is of course opposite to that in which the light enters the individual layers on exposure. Thus, in the colour photographic recording material according to the invention, two or more blue-sensitive silver halide emulsion layers may also be present in known manner instead of a single blue-sensitive silver halide emulsion layer, although they are in any case arranged adjacent to one another. In addition, each of the above-mentioned red-sensitive or green-sensitive component layers may in turn be divided up into two or more sub-component layers, provided these sub-component layers are not separated from one another by silver halide emulsion layers of different spectral sensitivity.

Hints at colour photographic materials containing three or more green-sensitive layers may also be found for example in German Offenlegungsschrift No. 2,530,645. In this case, however, a large number of magenta forming layers is accompanied by an equally large number of cyan-forming layers in addition to which a cyan-forming layer has to be arranged between any two magenta-forming layers. A structure such as this has a large number of interfaces between red-sensitive and green-sensitive layers which necessitates a correspondingly large number of intermediate layers to avoid undesirable co-coupling.

As already mentioned, the colour photographic recording material according to the invention contains at least two lightsensitive component layers of different sensitivity for producing the cyan component colour image and at least three such layers for producing the magenta component colour image. The sensitivity to be considered here is not the absolute sensitivity, but instead the effective sensitivity, taking into account the particular position within the colour photographic multilayer material. The difference in the effective sensitivity preferably amounts to between 0.2 and 1.0 relative log I.t-units. In a particular case, the difference in sensitivity is selected so that an essentially linear gradation curve without any noticeable distortion is obtained on colour photographic processing.

Measures for adjusting a required sensitivity level are known and include, for example, changing the silver iodide content, the extent of physical ripening (grain size), the degree of chemical or spectral sensitization or adding a desensitizer. In the interests of as high a total sensitivity as possible, the "less sensitive" and the "least sensitive" component layer should of course also have as high a sensitivity as possible provided only that the sensitivity relation required in accordance with the invention remains preserved.

The constituents in each more sensitive layer should best be measured in such a way that a lower colour density is obtained in this layer on colour development than in each less sensitive layer of the same spectral sensitivity. According to the invention, this is preferably achieved by altering the coupler-to-silver ratio. A colour coupler which is capable of reacting with colour developer oxidation products to form a non-diffusing dye is associated with each of the above-mentioned photosensitive silver halide emulsion layers. The colour couplers should be non-diffusing and are accommodated in the photosensitive layer itself or in the immediate proximity thereof.

The colour couplers associated with the two or three component layers of the same spectral sensitivity do not necessarily have to be identical. They are only required to give the same colour on colour development, normally a colour which is complementary to the colour of the light to which the photosensitive silver halide emulsion layers are sensitive. Accordingly, at least one non-diffusing colour coupler for producing the cyan component colour image, generally a coupler based on phenol or $\alpha$-naphthol, is associated with each of the red-sensitive silver halide emulsion layers. The green-sensitive silver halide emulsion layers each contain at least one diffusion-resistant colour coupler for producing the magenta component colour image, normally a colour coupler based on 5-pyrazolone or indazolone. Finally, the blue-sensitive silver halide emulsion layers each contain at least one diffusion-resistant colour coupler for producing the yellow component colour image, generally a colour coupler containing an open-chain ketomethylene group.

Colour couplers such as these are known in large numbers and are described in a number of patent specifications. Reference is made here for example to the publications "Farbkuppler" by W. Pelz in "Mitteilungen aus den Forschungslaboratorien der Agfa, Leverkusen/Munchen," Vol. III, page 111, (1961), and K. Venkataraman in "The Chemistry of Synthetic Dyes," Vol. 4, 341 to 387, Academic Press (1971).

The colour couplers may be both standard 4-equivalent couplers and also 2-equivalent couplers in which a smaller quantity of silver halide is required for colour production. 2-Equivalent couplers are derived in known manner from the 4-equivalent couplers in that they contain in the coupling site a substituent which is released during coupling. 2-Equivalent couplers which may be used in accordance with the invention include both those which are substantially colourless and also those which have an intensive natural colour which disappears during colour coupling or is replaced by the colour of the image dye produced. According to the invention, the latter couplers may also be additionally present in the photosensitive silver halide emulsion layers where, as masking couplers, they serve to compensate the undesirable side densities of the image dyes. The 2-equivalent couplers also include the known white couplers although these known white couplers do not form a dye on reaction with colour developer oxidation products. The 2-equivalent colour couplers also include the known DIR-couplers which are capable of releasing a diffusable development inhibitor on reaction with colour developer oxidation products.

It is possible if required to use colour coupler mixtures in order to adjust a particular colour or to obtain a desired reactivity. For example, hydrophilic water-soluble couplers may be used in combination with hydrophobic water-insoluble couplers. Hydrophobic and hydrophilic couplers for producing the same component colour image may also be combined with one another, for example by incorporating hydrophobic couplers in a less sensitive component layer and hydrophilic couplers in a more sensitive component layer. Thus, a hydrophobic magenta coupler may be incorporated both in the least sensitive green-sensitive component layer and also in the green-sensitive component layer of medium sensitivity, whilst a hydrophilic magenta coupler may be incorporated in the most sensitive green-sensitive component layer. Other combinations are also possible.

Whereas hydrophilic couplers are generally added to the emulsion in the form of aqueous alkaline solutions, hydrophobic couplers are best incorporated by one of the known emulsification processes in which for example the coupler is dissolved in an organic solvent, optionally in the presence of a high-boiling coupler solvent, and then dispersed in a gelatin solution. Examples of high-boiling coupler solvents are dibutyl phthalate and tricresyl phosphate. Other coupler solvents are described for example in U.S. Pat. Nos. 2,322,027; 3,689,271; 3,764,336 and 3,765,897.

It is also possible to prepare aqueous dispersions of the hydrophobic couplers and to add them to the particular casting solutions. To this end, aqueous suspensions of the couplers are finely ground, for example by intensive stirring with addition of sharp sand and/or by applying ultrasonic waves. In this connection, reference is also made to our copending U.K. patent application No. 9905/77.

Preferably, at least the less sensitive red-sensitive silver halide emulsion layer or the least sensitive green-sensitive silver halide emulsion layer or an intermediate layer there between contains a diffusion-resistant compound which is capable of releasing a diffusable development inhibitor on reaction with colour developer oxidation products. Additionally also the comparatively more sensitive emulsion layers or intermediate layers adjacent thereto may contain diffusion-resistant compounds of the type which are capable of releasing a diffusable development inhibitor on reaction with developer oxidation products. Development inhibitor releasing compounds such as these are, for example, the known DIR-couplers which are 2-equivalent couplers which release a diffusing development inhibitor during colour coupling whilst at the same time a dye is formed from the coupler molecule. DIR-couplers such as these are described for example in U.S. Pat. No. 3,227,554.

However, it is particularly preferred to use development inhibitor releasing compounds of the type which release a development inhibitor on reaction with colour developer oxidation products without at the same time forming a dye. Compounds such as these, which may be referred to as DIR-compounds to distinguish them from the DIR-couplers, are described for example in U.S. Pat. No. 3,632,345. In this connection, reference is also made to German Offenlegungsschriften Nos. 2,362,752; 2,359,295; 2,405,442; 2,448,063 and 2,529,350.

The intermediate layers which are arranged between the photosensitive silver halide emulsion layers and of which the binder preferably consists of gelatin may contain compounds which are capable of reacting with colour developer oxidation products and which therefore prevent undesirable diffusion of the colour developer oxidation products. Examples of such compounds are non-diffusing reducing agents, for example hydroquinone derivatives, or couplers which do not form a dye remaining in the layers on reaction with the colour developer oxidation products. The already mentioned white couplers are particularly suitable for this purpose, although it is also possible to use colour couplers which form a soluble dye that is washed out of the layers during colour photographic processing. Other suitable compounds for suppressing the undesirable diffusion of colour developer oxidation products are described, for example, in E. J. Birr's work entitled "Stabilisation of Photographic Silver Halide Emulsions, " The Focal Press, 1st Edition, 1974, pages 116 to 122.

For other suitable additives to the colour photographic recording materials according to the invention or to one of their layers, reference is made to the article in the Journal "Product Licensing Index, " Vol. 92, December 1971, pages 107 to 110.

The recording materials according to the invention may be developed with the usual colour developer compounds, particularly those based on p-phenylene diamine containing a primary amino group, for example 4-amino-N,N-dimethyl aniline, 4-amino-N,N-diethyl aniline, 4-amino-3-methyl-N,N-diethyl aniline, 5-amino-3-methyl-N-methyl-N-(β-methylsulphonamidoethyl)-aniline, 4-amino-N-ethyl-(β-hydroxyethyl)-aniline, 4-amino-3-methyl-N-ethyl-N-(β-hydroxyethyl)-aniline, 4-amino-3-methyl-N-ethyl-N-(β-methoxyethyl)-aniline, 4-amino-3-methyl-N-ethyl-N-(β-methylsulphonamidoethyl)-aniline, 4-amino-N-butyl-N-(ω-sulphobutyl)-aniline, 4-amino-3-methyl-N-isopropyl-N-(ω-sulphobutyl)-aniline.

Other suitable colour developers are described for example, in J. Amer. Chem. Soc., 73, 3100–3125 (1951).

EXAMPLE 1

For comparison purposes, two different layer structures were produced by successively applying the layers described below to a transparent support layer provided with an antihalation layer. The quantities quoted are based in each case on 1 square meter. For the silver coating, the corresponding quantities of silver nitrate are quoted.

Structure 1 (corresponding to German Offenlegungsschrift No. 2,018,341)

1. A less sensitive red-sensitive layer with a red-sensitised mixture of a relatively insensitive silver bromide iodide emulsion (5 mole % of silver iodide) of 2.0 g of silver nitrate and a relatively sensitive silver bromide iodide emulsion (5 mole % of silver iodide) of 0.8 g of silver nitrate, 1.8 g of gelatin, 650 mg of cyan coupler corresponding to the formula

FORMULA I

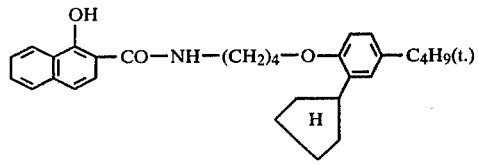

I 30 mg of a DIR-coupler corresponding to the formula

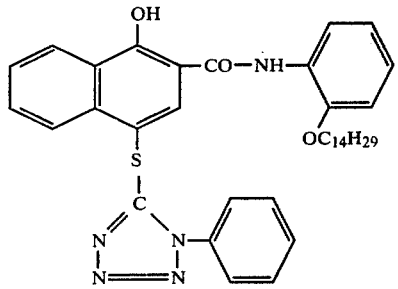

50 mg of a masking coupler corresponding to the formula

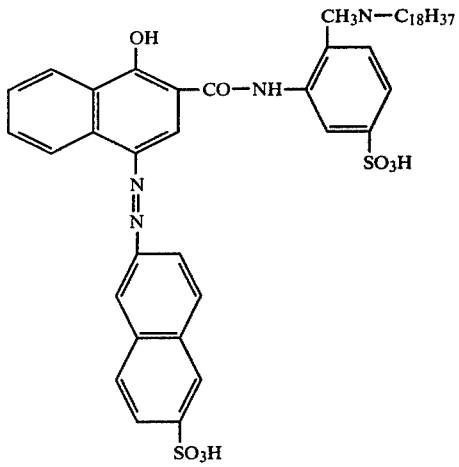

III

2. A more sensitive red-sensitive layer with a relatively sensitive red-sensitised silver bromide iodide emulsion (5 mole % of silver iodide) of 2.6 g of silver nitrate 1.7 g of gelatin 280 mg of cyan coupler corresponding to formula I 30 mg of masking coupler corresponding to formula III.

3. An intermediate layer of 0.7 g of gelatin.

4. A less sensitive green-sensitive layer with a relatively insensitive green-sensitised silver bromide iodide emulsion (5 mole % of silver iodide) of 2.7 g of silver nitrate 1.8 g of gelatin 540 mg of a magenta coupler corresponding to formula IV

IV

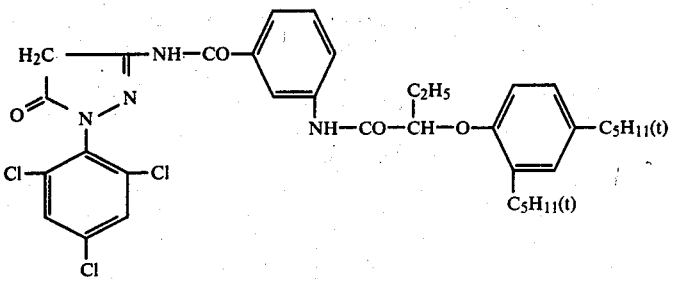

54 mg of a DIR-coupler corresponding to the formula

V

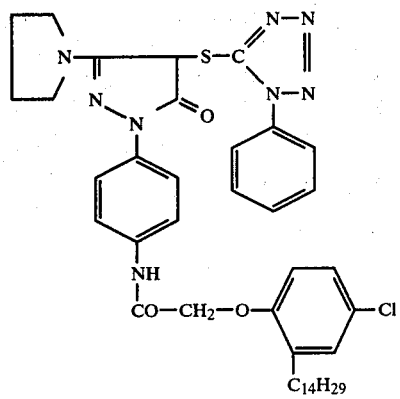

70 mg of masking coupler corresponding to the formula

VI

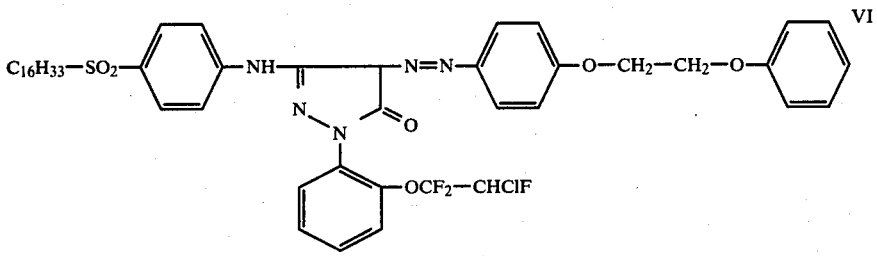

5. A medium-sensitivity green-sensitive layer with a green-sensitised silver bromide iodide emulsion (5 mole % of silver iodide) of 1.35 g of silver nitrate 1.0 g of gelatin 130 mg of a magenta coupler corresponding to formula IV 20 mg of a masking coupler corresponding to formula VI.

6. A highly sensitive green-sensitive layer with a green-sensitised silver bromide iodide emulsion (7 mole % of silver iodide) of 1.35 g of silver nitrate 0.95 g of gelatin 50 mg of a magenta coupler corresponding to the formula

VII

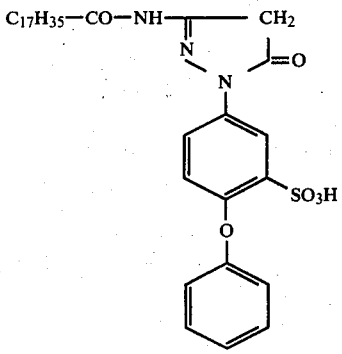

8 mg of a masking coupler corresponding to formula VI.

7. An intermediate layer with 0.7 g of gelatin.

8. A yellow filter layer with colloidal silver for producing a yellow density of 0.8, as measured behind a blue filter.

9. A blue-sensitive layer with a mixture of a relatively sensitive silver bromide iodide emulsion (9 mole % of silver iodide) of 1.0 g of silver nitrate and a relatively non-sensitive silver bromide iodide emulsion (1 mole % of silver iodide) of 0.6 g of silver nitrate, 2.0 g of gelatin 1.0 g of a yellow coupler corresponding to the formula

VIII

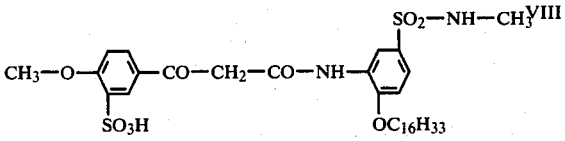

10. A surface layer of 0.7 g of gelatin.

Structure 2 (according to the invention)

The same layers having the same compositions as in layer 1 are used, but in a different order. The number of the corresponding layer in structure 1 is shown in brackets.

1. Less sensitive red-sensitive layer (1)
2. An intermediate layer of 0.7 g of gelatin
3. A less sensitive green-sensitive layer (4)
4. An intermediate layer of 0.7 g of gelatin
5. A more sensitive red-sensitive layer (2)
6. An intermediate layer of 0.7 g of gelatin
7. A medium-sensitivity green-sensitive layer (5)
8. A highly sensitive green-sensitive layer (6)
9. An intermediate layer of 0.7 g of gelatin
10. A yellow filter layer (8)
11. A blue-sensitive layer (9)
12. A surface layer (10).

The two different structures were exposed to white light behind a grey continuous wedge and subjected to a colour photographic processing cycle of the type described in "The British Journal of Photography," July 1974, pages 597 and 598. The sensitivities obtained, measured at density 0.2 over fog, are shown in the following Table:

| | Sensitivity [rel. log I . t] | | |
|---|---|---|---|
| Structure | yellow | magenta | cyan |
| 1 | 4.05 | 3.72 | 3.15 |
| 2 | 4.05 | 3.73 | 3.30 |

The sensitivity is expressed in relative log I·t-units. Higher numerical values represent higher sensitivity. It can be seen from the Table that a significantly higher sensitivity of the cyan component colour image is obtained with structure 2 according to the invention which was produced with the same casting solutions as the known structure 1, i.e. with substantially the same colour graininess.

What we claim is:

1. The color photographic recording material consisting of (a) a layer support having applied to it a plurality of layers including light-sensitive layers and including (b) three green-sensitive silver halide emulsion component layers of different speed each having associated with it a magenta-forming coupler including a least-sensitive green-sensitive silver halide emulsion layer, a more-sensitive green-sensitive silver halide emulsion layer having the ratio of silver halide to coupler higher than in the least-sensitive green-sensitive layer and arranged further from said layer support than said least-sensitive green-sensitive layer and a most-sensitive green-sensitive silver halide emulsion layer having a ratio of silver halide to coupler higher than in the more-sensitive green-sensitive layer and arranged further from said layer support than said more-sensitive green-sensitive layer;

(c) two red-sensitive silver halide component layers of different speed each having associated with it a cyan-forming coupler, including a less-sensitive red-sensitive silver halide emulsion layer, and a more-sensitive red-sensitive silver halide emulsion layer having a ratio of silver halide to coupler higher than in the less-sensitive red-sensitive layer;

(d) at least one non-light-sensitive yellow filter layer is located further removed from the layer support than any one of said red-sensitive layers, and green-sensitive layers, and (e) one or more blue-sensitive silver halide emulsion layers each having associated with it a yellow-forming coupler and being located further removed from the layer support than said yellow filter layer;

wherein the improvement comprises each of the green-sensitive layers being arranged further away from the layer support than the less-sensitive red-sensitive layer, the more-sensitive red-sensitive layer is located between the more-sensitive green-sensitive layer and the most-sensitive green-sensitive layer, whereby said more sensitive red-sensitive layer being less adjacent the layer support than said more-sensitive green-sensitive layer and said less-sensitive red-sensitive layer.

2. The color photographic recording material consisting of (a) a layer support having applied to it a plurality of layers including light-sensitive layers and including (b) three green-sensitive silver halide emulsion component layers of different speed each having associated with it a magenta-forming coupler including a least-sensitive green-sensitive layer silver halide emulsion, a more-sensitive green-sensitive silver halide emulsion layer, having the ratio of silver halide to coupler higher than in the least-sensitive green-sensitive layer and arranged further from said layer support than said least-sensitive green-sensitive layer and a most-sensitive green-sensitive silver halide emulsion layer having a ratio of silver halide to coupler higher than in the more-sensitive green-sensitive layer and arranged further from said layer support than said more-sensitive green-sensitive layer;

(c) two red-sensitive silver halide component layers of different speed each having associated with it a cyan-forming coupler, including a less-sensitive red-sensitive silver halide emulsion layer, and a more-sensitive red-sensitive silver halide emulsion layer having a ratio of silver halide to coupler higher than in the less-sensitive red-sensitive layer;

(d) at least one non-light-sensitive yellow filter layer located further removed from the layer support than any one of said red-sensitive and green-sensitive layers, and (e) one or more blue-sensitive silver halide emulsion layers each having associated with it a yellow-forming coupler and being located further removed from the layer support than said yellow filter layer;

wherein the improvement comprises each of the green-sensitive layers being arranged further away from the layer support than the less-sensitive red-sensitive layer the more-sensitive red-sensitive layer is located between the least-sensitive green-sensitive layer and the more-sensitive green-sensitive layer, whereby said more-sensitive red-sensitive layer being less adjacent the layer support than said least-sensitive green-sensitive layer and said less-sensitive red-sensitive layer.

3. A material as claimed in claim 2 in which the difference in effective sensitivities of layers producing the same component color image is from 0.2 to 1.0 relative log I×t units.

4. A material as claimed in claim 1 in which the difference in effective sensitivities of layers producing the same component colour image is from 0.2 to 1.0 relative log I×t units.

* * * * *